United States Patent [19]

Ross

[11] 4,156,585

[45] May 29, 1979

[54] GEROTOR DEVICE WITH PORTING THROUGH ECCENTRIC DRIVE

[75] Inventor: Louis Ross, Des Plaines, Ill.

[73] Assignee: Borg-Warner Corporation, Chicago, Ill.

[21] Appl. No.: 839,089

[22] Filed: Oct. 3, 1977

[51] Int. Cl.[2] ..... F01C 1/02; F01C 21/12; F03C 3/00; F04C 1/02

[52] U.S. Cl. ..... 418/61 B

[58] Field of Search ..... 418/61 R, 61 B

[56] References Cited

U.S. PATENT DOCUMENTS

| | | | |
|---|---|---|---|
| 3,270,683 | 9/1966 | McDermott | 418/61 B |
| 3,431,863 | 3/1969 | Waldorff | 418/61 B |
| 3,905,727 | 9/1975 | Kilmer | 418/61 B |
| 4,025,243 | 5/1977 | Stephens | 418/61 B |

*Primary Examiner*—John J. Vrablik
*Attorney, Agent, or Firm*—Julian Schachner

[57] ABSTRACT

A fluid pressure device of the type including a housing in which a gerotor gear set is supported. The gear set includes an externally toothed star gear rotating within an internally toothed ring gear. The housing and ring gear each define complementary but eccentrically oriented races between which balls are contained so as to establish orbital movement of the ring gear. The housing and ring gear define passages communicating through the eccentric drive to supply and exhaust fluid to and from chambers defined between the star and ring gears.

5 Claims, 3 Drawing Figures

GEROTOR DEVICE WITH PORTING THROUGH ECCENTRIC DRIVE

BACKGROUND OF THE INVENTION

This invention relates generally to fluid pressure devices. More particularly, it relates to hydraulic pumps or motors of the gerotor type wherein a ring gear orbits and a star gear rotates. The mechanism for effecting orbital movement of the ring gear also controls the porting of fluid into and out of the fluid chambers defined between the gears.

In recent years there have been many improvements in gerotor type pumps and motors. Some such devices incorporate a fixed ring gear within which a star gear is supported for orbital and rotational movement. A wobble shaft necessarily is associated with the star gear in order to compensate for its orbital movement. Other such devices include an orbital ring gear and a rotatable star gear, so as to eliminate the necessity of the wobble shaft. Devices of this nature heretofore have required complicated valving arrangements for controlling the porting of fluid into and out of the fluid chambers between the gears.

There remains a need for a fluid pressure device of the gerotor type having an externally toothed star gear rotating within an internally toothed ring gear, wherein the ring gear is supported for orbital movement and includes a mechanism for efficiently controlling the flow of fluid to and from the device. There is a further need for such a device which is susceptible of precise and economical manufacture and efficient operation.

SUMMARY OF THE INVENTION

This invention is directed to a fluid pressure device of the gerotor type which will meet the needs noted above. The device includes a housing, an internally toothed ring gear and an externally toothed star gear. The housing and ring gear define a simple, eccentric drive mechanism for allowing orbital movement of the ring gear. High and low pressure ports controlled by the eccentric drive mechanism are communicated with the fluid chambers between the gears in timed relation through passages defined by the ring gear. The star gear is supported on a shaft for rotational movement within the ring gear. The porting arrangement results in precise control of fluid flow into and out of the fluid chambers defined between the gears, while at the same time insuring minimal fluid losses. Manufacture is simplified by the fact that the elements are grouped on the same side of the ring gear.

Thus, the requirements of various manufacturers for low speed, high torque pumps and motors of the gerotor type may be easily and simply satisfied with a simplified and economical assembly, as will be described.

BRIEF DESCRIPTION OF THE DRAWING

The objects and advantages of this invention will become apparent to those skilled in the art upon careful consideration of the specification herein, including the drawing, wherein.

Figure 1:
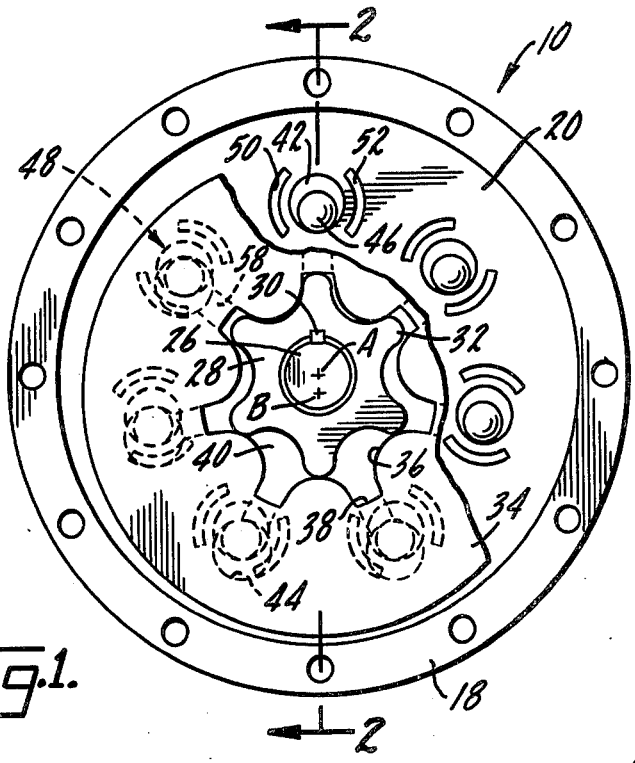
FIG. 1 is an elevational view with the housing cover removed and the ring gear partially cut away to show details of the invention.
Figure 2:
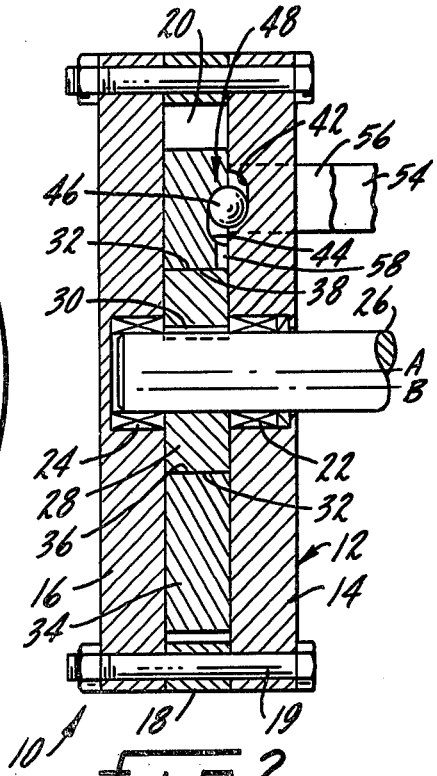
FIG. 2 is a sectional view taken along the line 2—2 of FIG. 1 showing additional details of the invention.
Figure 3:
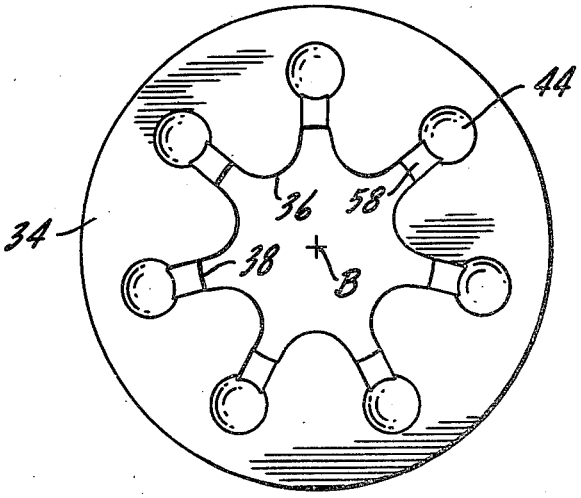
FIG. 3 is a view of the ring gear showing the side opposite to that shown in FIG. 1.

While this invention is susceptible of embodiment in many different forms, there is shown in the drawing and herein will be described in detail a preferred embodiment. It should be understood that the present disclosure is considered to be an exemplification of the principles of the invention, and is not intended to limit the invention to this embodiment.

DESCRIPTION OF THE PREFERRED EMBODIMENT

Referring now to the drawing in greater detail, there is shown an improved fluid pressure device 10 incorporating a gerotor type fluid pump or motor. This device 10 includes a housing 12 having a housing section 14, a housing section 16 in the form of a cover, and a housing section 18 in the form of a spacer ring. Housing sections 14, 16 and 18 are secured together by suitable bolts 19 or the like to define therewithin a suitable pump or motor cavity 20.

A bearing 22 is supported by housing section 14. Similarly, a bearing 24 is supported by housing section 16 in axial alignment with bearing 22. A shaft 26 is journalled in bearings 22 and 24 for rotation about a first axis A.

Within cavity 20 a star gear 28 is secured to shaft 26 by a suitable key 30 or the like. Star gear 28 defines a plurality of external gear teeth 32. Also within cavity 20 is a ring gear 34 having a second axis B parallel to axis A. Ring gear 34 defines a plurality of internal gear teeth 36. Ring gear 34 also defines a bottom land 38 between each pair of adjacent teeth 36. In the preferred form of the invention shown herein, star gear 28 defines six teeth 32 and ring gear 34 defines seven teeth 36. Star gear 28 and ring gear 34 together form a plurality of fluid chambers 40.

Housing section 14 defines a plurality of first, fixed bearing races 42 oriented concentrically about axis A. Each race 42 preferably has a semi-toroidal configuration. In a similar manner, ring gear 34 defines a plurality of second, orbital bearing races 44 oriented concentrically about axis B. Each race 44 also preferably takes the form of a semi-toroid. Each race 44 is on a radius extending from axis B through an adjacent bottom land 38 of ring gear 34. Races 42 and 44 are complementary and are equidistant from axes A and B, respectively. Thus, they are eccentric relative to each other by the distance between axes A and B. Suitable rolling elements 46 in the form of balls or the like are supported in rolling contact with races 42 and 44 so as to define therewith an eccentric drive mechanism 48. This mechanism 48 is constructed such that as balls 46 roll around races 42, ring gear 34 orbits such that axis B defines a circle about axis A.

Associated with each fixed race 42 are a pair of high and low pressure ports 50 and 52, respectively. These ports 50 and 52 are defined by housing section 14 and preferably are kidney-shaped, having inner and outer surfaces concentric with their associated fixed races 42. In the preferred form of the invention shown herein, the outer edges of races 44 coincide with the outer surfaces of ports 50 and 52 as ring gear 34 orbits.

A suitable high pressure inlet 54 communicates through housing section 14 with each high pressure port 50. Similarly, a suitable low pressure outlet 56 communicates through housing section 14 with each low pressure port 52. A plurality of fluid passages 58 are defined by ring gear 34. Each passage 58 extends across the width of a bottom land 38, and communicates with its associated orbital race 44.

Assuming that the fluid pressure device 10 is operated as a low speed, high torque motor, fluid is directed through high pressure inlet 54 to high pressure ports 50. Porting is controlled by eccentric drive mechanisms 48, and fluid is directed sequentially from ports 50 through their associated eccentric drive mechanisms 48 and passages 58 into some chambers 40. At the same time, fluid is directed from other chambers 40 through passages 58 and, under the control of associated eccentric drive mechanisms 48, sequentially to ports 52 and low pressure outlet 56.

Ring gear 34 orbits about axis A, but does not rotate. Star gear 28 rotates on axis A, but does not orbit. As ring gear 34 orbits, eccentric drive mechanisms 48 act as valves to time fluid flow from high pressure ports 50 sequentially into chambers 40, and from chambers 40 sequentially to low pressure ports 52. Star gear 28 and shaft 26 are rotated at a low speed, with the resulting torque multiplication determined by the number of teeth 32 vis-a-vis teeth 36.

An important advantage resulting from the use of eccentric drive mechanisms 48 as fluid control valves is that they are assured of constant lubrication.

Device 10 could be operated as a pump by rotating shaft 26. Star gear 32 would rotate, ring gear 34 would orbit, and fluid would be drawn in through inlet 54 and forced out through outlet 56.

Thus, it will be seen that a fluid pressure device of the gerotor type has been provided wherein the ring gear orbits, the star gear rotates, and the flow of fluid is controlled by an eccentric drive mechanism. The device is simple and susceptible of easy and precise manufacture. The device incorporates a minimum number of parts and operates with minimum losses. Manufacture is facilitated by grouping the fluid control elements on the same side of the ring gear.

While a preferred embodiment of the invention has been shown and described, this should be considered as illustrative and may be modified by those skilled in the art. It is intended that the claims herein cover all such modifications as may fall within the spirit and scope of the invention.

What is claimed is:

1. In a fluid pressure device including a housing defining a cavity, an externally toothed star gear supported in said cavity for rotation on an axis fixed with respect to said housing, and an internally toothed ring gear in said cavity, said star and ring gear teeth being engageable to define expanding and contracting fluid chambers as said star gear rotates and said ring gear orbits; the improvement comprising a plurality of fixed races defined by said housing in spaced relationship to said axis, a plurality of orbital races defined by said ring gear in spaced relationship to said axis and eccentric to said fixed races, a plurality of rolling elements, each rolling element being in rolling contact with a fixed and an orbital race to define therewith eccentric drive means, said eccentric drive means permitting orbital movement of said ring gear about said axis and restraining rotational movement of said ring gear, and a plurality of fluid ports defined by said housing in spaced relationship to each fixed race, each orbital race communicating sequentially with said fluid ports as said ring gear orbits, thereby effecting porting of fluid to and from said fluid chambers as said ring gear orbits.

2. A gerotor device comprising a housing defining a cavity and fluid inlet and outlet means, a gerotor gear set in said cavity, said gear set including a star gear having a first axis and a ring gear having a second axis parallel to said first axis, a rotatable shaft journalled in said housing and extending therefrom on said first axis, said star gear secured to said shaft for rotation therewith, a plurality of eccentric drive means each including first and second semi-toridal shaped bearing races respectively defined by said housing and ring gear, said first and second races being equidistant respectively from said first and second axes, and a plurality of balls each in rolling contact with a first and second race such that as said balls roll in said races said ring gear orbits so that said second axis describes a circle about said first axis, said ring gear defining fluid passage means communicating said second races with fluid chambers defined by said gears, and said housing defining a plurality of pairs of ports communicating respectively with said inlet and outlet means, each pair of ports being adjacent a first race and oriented such that fluid communication is established therewith by said second race as said ring gear orbits.

3. The invention of claim 2, said ports being concentric with and spaced from their associated first races.

4. The invention of claim 2, each of said fluid passages communicating its associated second race with a bottom land of said ring gear between adjacent teeth thereof.

5. The invention of claim 4, each of said fluid passages extending across the entire width of its associated bottom land.

* * * * *